US007992707B2

(12) United States Patent
Henry

(10) Patent No.: US 7,992,707 B2
(45) Date of Patent: Aug. 9, 2011

(54) STORAGE UNIT

(75) Inventor: Lou Henry, Scarsdale, NY (US)

(73) Assignee: Town & Country Linen Corp,, New York, NY (US)

( * ) Notice: Subject to any disclaimer, the term of this patent is extended or adjusted under 35 U.S.C. 154(b) by 0 days.

(21) Appl. No.: 12/729,727

(22) Filed: Mar. 23, 2010

(65) Prior Publication Data

US 2010/0236946 A1 Sep. 23, 2010

Related U.S. Application Data

(60) Provisional application No. 61/248,736, filed on Oct. 5, 2009, provisional application No. 61/210,883, filed on Mar. 23, 2009, provisional application No. 61/162,215, filed on Mar. 23, 2009.

(51) Int. Cl.
*B65D 85/20* (2006.01)
*B65D 43/26* (2006.01)

(52) U.S. Cl. ..... 206/15.3; 206/446; 220/264

(58) Field of Classification Search ..... 206/349, 206/361–15.3, 446; 220/263, 264, 825–827, 220/262; 4/255.05, 255.11
See application file for complete search history.

(56) References Cited

U.S. PATENT DOCUMENTS

| | | | | |
|---|---|---|---|---|
| 2,757,787 | A * | 8/1956 | Sergent | 206/361 |
| 5,170,904 | A * | 12/1992 | Neuhaus | 220/262 |
| 5,292,023 | A * | 3/1994 | Yen | 220/264 |
| 5,941,379 | A * | 8/1999 | Barardo | 206/209 |
| 5,958,150 | A * | 9/1999 | Borger et al. | 206/15.3 |
| 6,431,393 | B1 * | 8/2002 | Stewart | 220/826 |
| 6,601,700 | B1 * | 8/2003 | Rudnick et al. | 206/349 |
| 6,837,393 | B1 * | 1/2005 | Kuo | 220/263 |
| 6,926,137 | B2 * | 8/2005 | Rudnick et al. | 206/15.3 |
| 7,185,759 | B2 * | 3/2007 | Rich | 206/349 |
| 7,210,595 | B2 * | 5/2007 | Smith | 220/9.4 |

* cited by examiner

*Primary Examiner* — Bryon Gehman
(74) *Attorney, Agent, or Firm* — Amster, Rothstein & Ebenstein LLP

(57) ABSTRACT

A storage unit is disclosed comprising a container disposed within a housing, the container having a cavity with an opening at the upper end for receiving an item. A cover comprises two or more rounded cover sections pivotally mounted between the container and the housing for movement between an open position and a closed position, the cover sections being biased toward the open position. Vertical downward movement of the container toward the bottom wall of the housing causes the cover sections to overcome the bias and rotate to the closed position. When rotating to the open position, the cover sections recede into a receiving space between the housing and container, thereby exposing the cavity, such that the outer form factor of the storage unit is no larger in the open position than in the closed position.

14 Claims, 4 Drawing Sheets

STORAGE UNIT

STATEMENT OF RELATED APPLICATIONS

This application claims priority to U.S. Provisional Patent Application Nos. 61/210,883 and 61/162,215, which were filed with the U.S. Patent and Trademark Office on Mar. 23, 2009, and U.S. Provisional Patent Application No. 61/248,736, which was filed with the U.S. Patent and Trademark Office on Oct. 5, 2009.

FIELD OF THE INVENTION

The present invention relates to the field of storage units. More particularly, the present invention is directed to a storage unit with rounded cover sections that rotate to the open and closed position when an article is placed in the storage unit, and wherein the outer form factor of the storage unit is no larger in the open position than it is in the closed position.

SUMMARY OF THE INVENTION

According to one embodiment, a storage unit comprises a housing having a bottom wall, sidewalls connected to the bottom wall, and an open upper end; a container disposed within the housing being vertically slidable relative to the bottom wall of the housing, the container having a cavity with an opening at the upper end for receiving the head portion of the item; and a cover comprising two or more rounded cover sections pivotally mounted between the container and the housing for movement between an open position exposing the upper end of the cavity of the container and a closed position closing the upper end of the cavity of the container from the outside environment, the cover sections being biased toward the open position, vertical downward movement of the container toward the bottom wall of the housing causing the cover sections to overcome the bias and rotate to the closed position, the cover sections in the closed position defining an aperture in the cover through which the handle of the item is to be extended, wherein an inner surface of the housing and an outer surface of the container define a receiving space in which the cover sections are received when rotated to the open position such that the outer form factor of the storage unit is no larger in the open position than in the closed position.

BRIEF DESCRIPTION OF THE DRAWINGS

Exemplary embodiments of this invention will be described with reference to the accompanying figures.

DETAILED DESCRIPTION OF THE EXEMPLARY EMBODIMENTS

The present invention is directed to a storage unit for storing an item that has a head portion and handle or neck portion extending therefrom. In a first embodiment, shown in FIGS. 1-3, a storage container 10 for storing a toilet brush 60 is disclosed.

Figure 1:
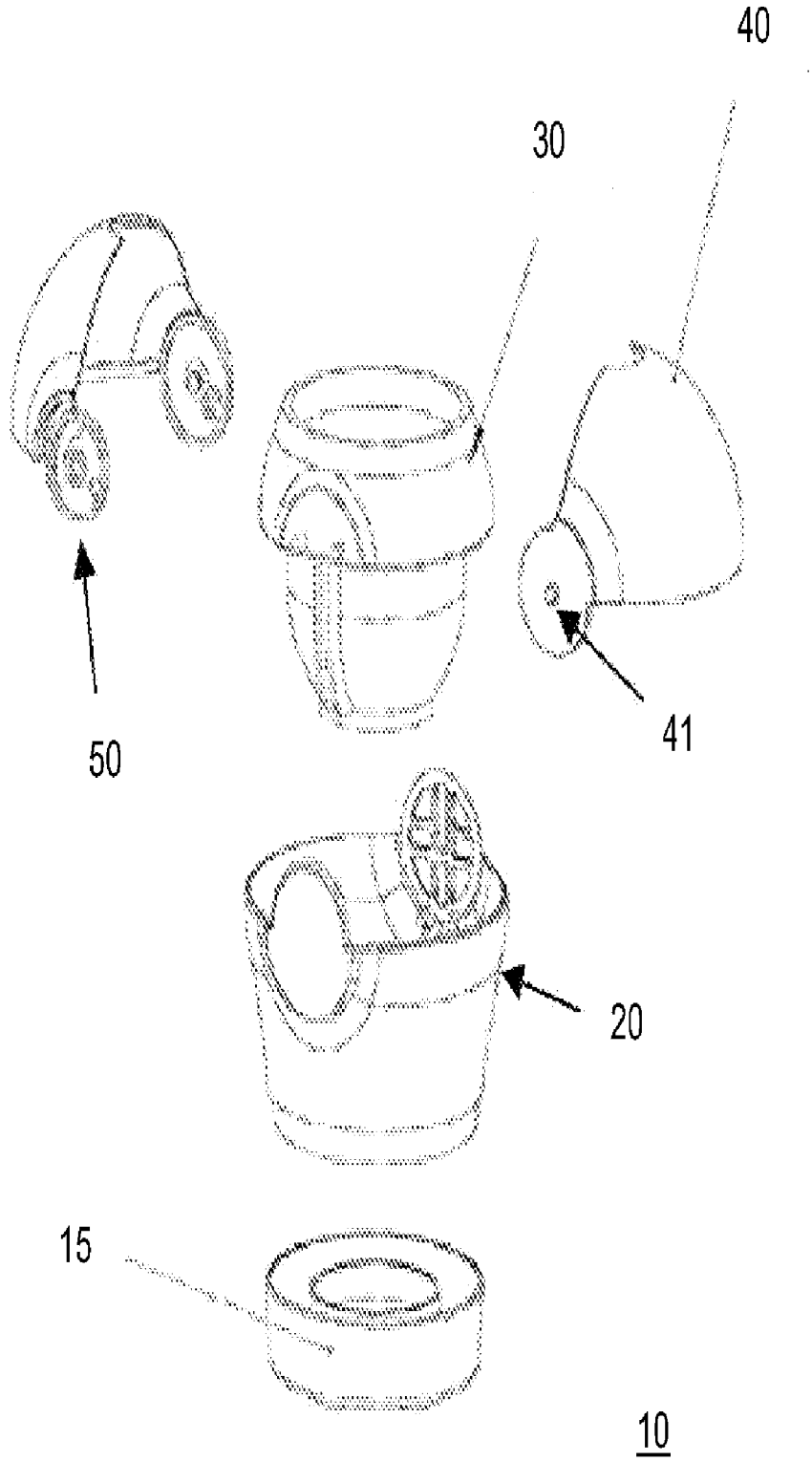
FIG. 1 is a exploded view of the components of a storage container according to an exemplary embodiment of the present invention.

Referring to FIG. 1, an exploded view of the storage unit of the present invention is disclosed. The storage unit includes a housing 20 in which a container 30 is disposed. The container 30 has a cavity with an open upper end into which the head of the article may be inserted, while the handle of the article remains extended upwards through the open upper end of the container 30. A cover comprised of two rotatable cover sections 40 opens and closes the open upper end of the container 30. The two cover sections 40 are pivotably mounted at common pivot points at opposite sides of the container 30 so as to be rotatable between an open position (shown in FIG. 2) and a closed position (shown in FIG. 3).

Figure 2:
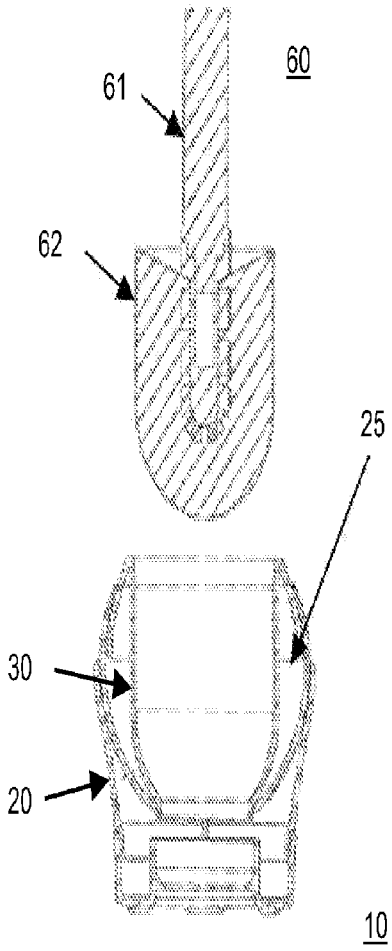
FIG. 2 is a front view of the storage container in the open state according to an exemplary embodiment of the present invention.

Referring to FIG. 2, the storage container 10 of the present invention is shown in the open position. When rotated to the open position, the cover sections 40 are received in an annular 25 space defined between the container 30 and the housing 20. Because the cover sections 40 are received in the annular space 25, the cover sections 40 do not extend beyond the outer dimensions of the housing 20, thereby keeping the form factor of the storage unit 10 the same when opened and closed.

Figure 3:
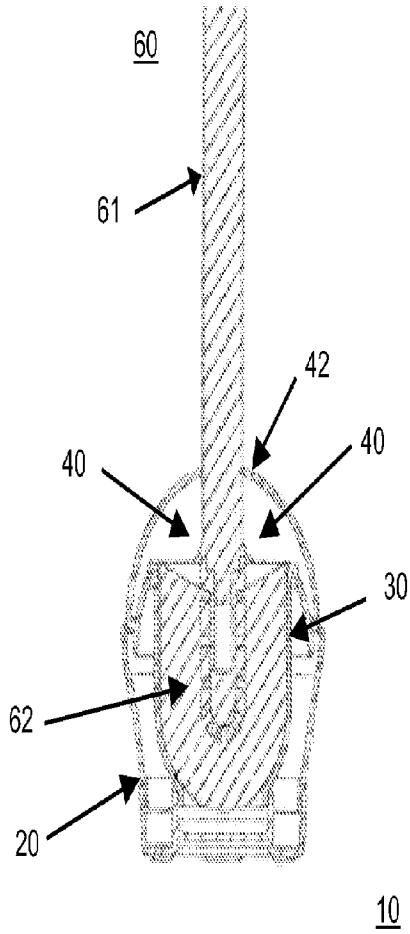
FIG. 3 is a front view of the storage container in the closed state according to an exemplary embodiment of the present invention.

Referring to FIG. 3, the storage container 10 of the present invention is shown in the closed position. When rotated to the closed position, the cover sections 40 meet in an abutting position that closes the open upper end of the container 30. The closed cover sections 40 define a hole 42 in the center through which the handle 61 of the brush 60 extends.

The cover sections 40 are biased by a spring towards the open position. The spring is preferably a torsional spring 41 located around at least one of the common pivot points of the two cover sections 40, however the spring may also be a compression spring located between the bottom of the container 30 and the bottom of the housing 20. When the head 62 of the brush 60 is inserted into the container 30, the weight of the brush 60 causes the container 30 to slide downward within the housing 20. A pivoting mechanism 50 located about the common pivot points of the cover sections 40 converts the downward movement of the container 30 into rotational movement of the cover sections 40, which overcomes the spring bias and causes the cover sections 40 to rotate to the closed position. When the brush 60 is lifted upward by a user, the downward force exerted by the weight of the brush is removed from the container 30, allowing the spring bias to rotate the cover sections 40 back to the open position.

In another embodiment, such as shown in FIGS. 4-7, a storage unit for storing an article such as a wine bottle is disclosed. In this embodiment a storage unit 11 may be an insulated chamber for maintaining the temperature of a bottle of wine 70.

Figure 4:
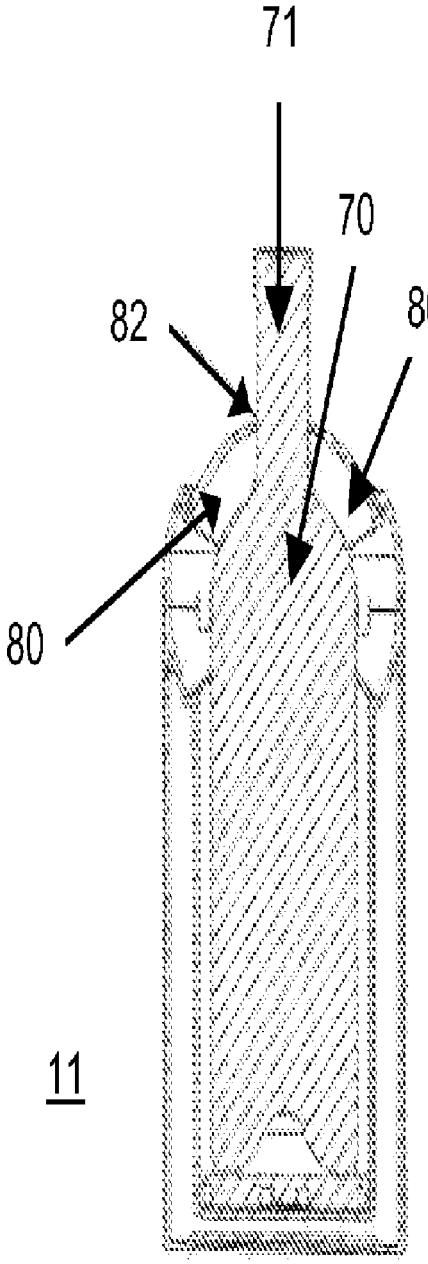
FIG. 4. is a front view of the storage container in the closed state according to a second embodiment of the present invention.

Referring to FIG. 4, a storage unit 11 includes a housing 90 in which a container 100 is disposed. The container 100 has a cavity with an open upper end into which the head of the bottle 70 may be inserted, while the neck portion 71 of the bottle 70 remains extended upwards through the open upper end of the container. A cover comprised of two rotatable cover sections 80 opens and closes the open upper end of the container 100. The two cover sections 80 are pivotably mounted at common pivot points at opposite sides of the container 100 so as to be rotatable between an open position (shown in FIG. 5) and a closed position (shown in FIG. 4). The container 100 and housing 90 may be insulated or contain a heating or cooling element such that the bottle 70 can be maintained at a particular temperature.

Referring to FIG. 4, the storage container 11 of the present invention is shown in the closed position. When rotated to the closed position, the cover sections 80 meet in an abutting position that closes the open upper end of the container 100. The closed cover sections 80 define a hole 82 in the center through which the neck 71 of the bottle 70 extends.

Figure 5:
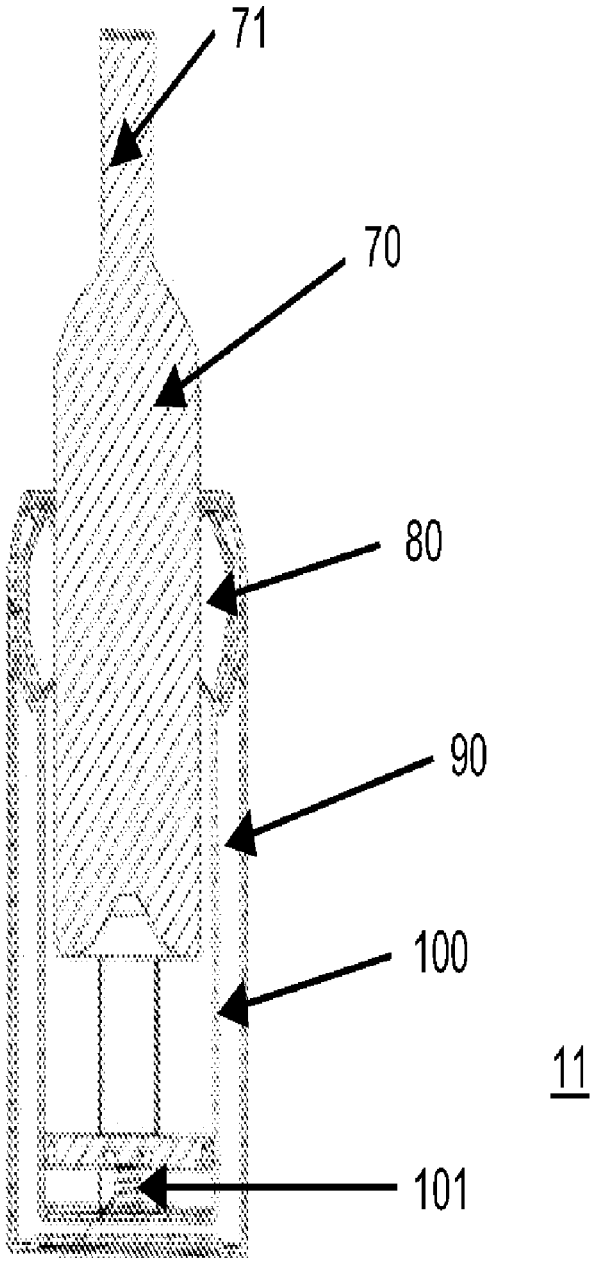
FIG. 5. is a front view of the storage container in the open state according to a second embodiment of the present invention.

Referring to FIG. 5, the storage container 11 of the present invention is shown in the open position. When rotated to the open position, the cover sections 80 are received in an annular space defined between the container 100 and the housing 90. Because the cover sections 80 are received in the annular space, the cover sections 80 do not extend beyond the outer dimensions of the housing 90, thereby keeping the form factor of the storage unit 11 the same when opened and closed.

Figure 6:
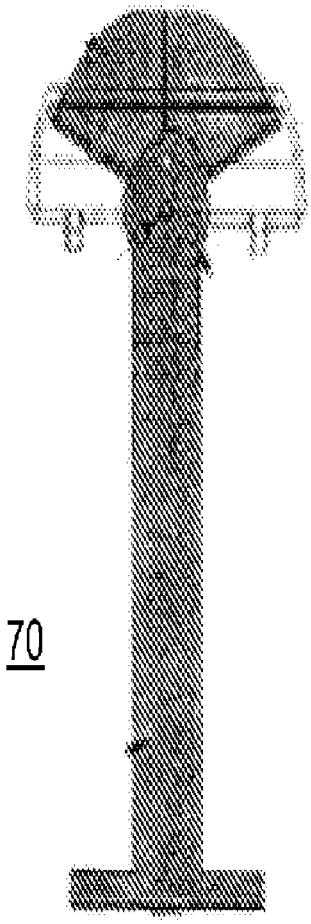
FIG. 6. is a cutaway side view of the storage container in the closed state according to a second embodiment of the present invention.
Figure 7:
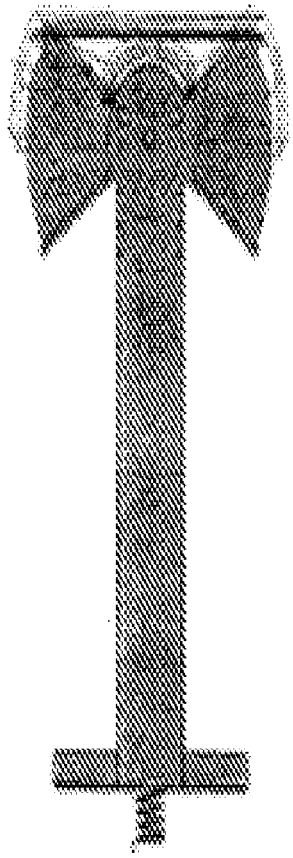
FIG. 7. is a cutaway side view of the storage container in the open state according to a second embodiment of the present invention.

FIG. 6 similarly shows this embodiment of the invention in the closed position, while FIG. 7 shows this embodiment of the invention in the opened position.

Now that embodiments of the present invention have been shown and described in detail, various modifications and improvements thereon will become readily apparent to those skilled in the art. For example, while the present invention is described as adapted to hold a toilet brush or wine bottle, it will be apparent to those skilled in the art that the present invention can be used to hold a variety of articles of various sizes, including, for example, a toothbrush, hair brush, soda bottle, etc. Accordingly, the exemplary embodiments of the invention, as set forth above, are intended to be illustrative, not limiting. The spirit and scope of the present invention is to be construed broadly and limited only by the appended claims, and not by the foregoing specification.

What is claimed is:

1. A storage unit for an item having a head portion and an elongated handle portion extending therefrom, the storage unit comprising:

a housing having a bottom wall, sidewalls connected to the bottom wall, and an open upper end;

a container disposed within the housing being vertically slidable relative to the bottom wall of the housing, the container having a cavity with an opening at an upper end of the cavity for receiving the head portion of the item; and a cover comprising two or more rounded cover sections pivotally mounted between the container and the housing for movement between an open position exposing the upper end of the cavity of the container and a closed position closing the upper end of the cavity of the container from an outside environment, the cover sections being biased by a biasing means toward the open position, vertical downward movement of the container toward the bottom wall of the housing causing the cover sections to overcome the bias and rotate to the closed position, the cover sections in the closed position defining an aperture in the cover through which the handle portion of the item is to be extended, wherein an inner surface of the housing and an outer surface of the container define a receiving space in which the cover sections are received when rotated to the open position such that the outermost horizontal circumference of the storage unit is no larger in the open position than in the closed position.

2. The storage unit of claim 1, wherein the each of the cover sections include diametrically opposed pivot elements which are mounted between the sidewalls of the housing and the container, the pivot elements including common pivots about which each of the cover sections rotate.

3. The storage unit of claim 2, wherein the pivot elements of each of the cover sections mounted at at least one of the common pivots includes a first slot oriented radially from the common pivot and a second slot curved in the direction of rotation about the common pivot, the container includes first and second pins on opposite sides of the common pivot, each pin being seated in the first slot of the pivot element of one of the cover sections and the second slot of the pivot element of the other cover section.

4. The storage unit of claim 3, wherein vertical downward movement of the container causes the pins to translate from a first end of the slots to a second end of the slots, thereby causing the cover sections to rotate from the open position to the closed position.

5. The storage unit of claim 2, wherein the cover sections are biased toward the open position by a torsional spring located about the common pivot of the cover sections.

6. The storage unit of claim 2, wherein the cover sections are biased toward the open position by a compression spring between the container and the bottom wall of the housing.

7. The storage unit of claim 1, wherein the head of the item is received in the container and the weight of the item pushing downward on the container overcomes the bias of the cover sections to rotate the cover sections to the closed position.

8. The storage unit of claim 1, wherein the biasing means rotates the cover sections from the closed position to the open position when the downward pressure on the container is less than the weight of the item.

9. The storage unit of claim 1, wherein the cover sections are releasably locked together when rotated to the closed position.

10. The storage unit of claim 1, wherein the cover sections are partial spherical shaped sections.

11. The storage unit of claim 1, wherein the item is a toilet bowl brush and the storage unit is a toilet bowl brush container.

12. The storage unit of claim 1, wherein the item is a tooth brush and the storage unit is a tooth brush container.

13. The storage unit of claim 1, wherein the item is a wine bottle and the storage unit is a wine bottle cooler.

14. A toilet bowl brush and storage unit system comprising:

a toilet bowl brush having head portion and an elongated handle portion extending therefrom; and a storage unit comprising:

a housing having a bottom wall, sidewalls connected to the bottom wall, and an open upper end;

a container disposed within the housing being vertically slidable relative to the bottom wall of the housing, the container having a cavity with an opening at an upper end of the cavity for receiving the head portion of the item; and a cover comprising two or more rounded cover sections pivotally mounted between the container and the housing for movement between an open position exposing the upper end of the cavity of the container and a closed position closing the upper end of the cavity of the container from an outside environment, the cover sections being biased by a biasing means toward the open position, vertical downward movement of the container toward the bottom wall of the housing causing the cover sections to overcome the bias and rotate to the closed position, the cover sections in the closed position defining an aperture in the cover through which the handle portion of the item is to be extended, wherein an inner surface of the housing and an outer surface of the container define a receiving space in which the cover sections are received when rotated to the open position such that the outermost horizontal circumference of the storage unit is no larger in the open position than in the closed position.

* * * * *